US009757611B1

(12) United States Patent
Colburn

(10) Patent No.: US 9,757,611 B1
(45) Date of Patent: Sep. 12, 2017

(54) DESK EXERCISE CYCLE

(71) Applicant: 3D Innovations, LLC, Greeley, CO (US)

(72) Inventor: Kevin Lawrence Colburn, Greeley, CO (US)

(73) Assignee: 3D Innovations, LLC, Greeley, CO (US)

( * ) Notice: Subject to any disclaimer, the term of this patent is extended or adjusted under 35 U.S.C. 154(b) by 0 days.

(21) Appl. No.: 14/156,336

(22) Filed: Jan. 15, 2014

(51) Int. Cl.
*A63B 22/06* (2006.01)

(52) U.S. Cl.
CPC ..... *A63B 22/0605* (2013.01)

(58) Field of Classification Search
CPC ..... A63B 22/0605–2022/0688; A63B 22/023; A63B 2022/0033
See application file for complete search history.

(56) References Cited

U.S. PATENT DOCUMENTS

| | | | | |
|---|---|---|---|---|
| 2,668,709 | A * | 2/1954 | Boyko | A63B 22/0007 482/60 |
| 4,390,177 | A * | 6/1983 | Biran | A63B 21/1609 188/83 |
| 4,632,386 | A | 12/1986 | Beech | |
| 5,257,701 | A | 11/1993 | Edelson | |
| 5,314,392 | A | 5/1994 | Hawkins et al. | |
| 5,472,396 | A * | 12/1995 | Brazaitis | 482/57 |
| 5,599,260 | A | 2/1997 | Rovinsky et al. | |
| 5,762,584 | A | 6/1998 | Daniels | |
| 5,807,211 | A * | 9/1998 | Berryhill | A63B 21/0552 482/129 |
| 5,807,212 | A | 9/1998 | Nelson | |
| 5,855,538 | A | 1/1999 | Argabright | |
| 6,027,429 | A | 2/2000 | Daniels | |
| 7,115,072 | B1 | 10/2006 | Stoll | |
| 7,533,894 | B2 | 5/2009 | Ehler | |
| 7,621,852 | B2 | 11/2009 | Bowser | |
| 7,686,742 | B2 | 3/2010 | Tischler et al. | |
| 7,901,331 | B1 * | 3/2011 | Stoll | 482/52 |
| 7,938,761 | B2 | 5/2011 | Simonson et al. | |
| 8,585,561 | B2 | 11/2013 | Watt et al. | |
| 2008/0058168 | A1 * | 3/2008 | Lin | A63B 22/0664 482/52 |
| 2009/0149300 | A1 * | 6/2009 | Chen | A63B 21/005 482/63 |
| 2014/0248999 | A1 * | 9/2014 | Lu | A63B 21/154 482/52 |

FOREIGN PATENT DOCUMENTS

| | | |
|---|---|---|
| TW | 498768 | 8/2002 |
| TW | M342183 | 10/2008 |
| TW | M359342 | 6/2009 |

OTHER PUBLICATIONS

Design U.S. Appl. No. 29/475,143, filed Nov. 29, 2013.
Isokinetics, Inc. Deluxe Pedal Exerciser. On-line catalog, http://www.isokineticsinc.com, originally downloaded Jan. 13, 2014, 1 page.

* cited by examiner

*Primary Examiner* — Loan H Thanh
*Assistant Examiner* — Jennifer M Deichl
(74) *Attorney, Agent, or Firm* — Craig R. Miles; CR Miles P.C.

(57) ABSTRACT

Motion resistance apparatuses and methods of use and, more specifically, leg-actuated motion resistance apparatuses configured for positioning beneath a fixed surface and for engagement by a seated user.

11 Claims, 7 Drawing Sheets

DESK EXERCISE CYCLE

This United States Non-Provisional Patent Application claims the benefit of U.S. Design patent application No. 29/475,143, filed Nov. 29, 2013, hereby incorporated by reference herein.

I. FIELD OF THE INVENTION

Motion resistance apparatuses and methods of use and, more specifically, to leg-actuated motion resistance apparatuses configured for positioning beneath a fixed height surface and for engagement by a seated user.

II. BACKGROUND OF THE INVENTION

The physical and emotional benefits of exercise are well known. However, as a result of increasingly demanding schedules, many people are not able to engage in regular exercise to the extent recommended by health care professionals.

In an effort to increase fitness, many workers incorporate exercise into their workday. This is advantageous not only to the employee but also to the employer, as healthy workers maximize productivity and minimize expenses related to the worker's health, such as insurance costs.

For workers with jobs that necessitate physical activity, exercising during the workday does not present a challenge. Conversely, for workers confined to working in a seated position, often at a desk and accompanying chair, exercising while working is significantly more difficult. Indeed, for many people, the majority of the day is habitually spent in a seated position at a desk in an office or home environment. Sitting in one position for long periods of time, termed postural fixity, can cause static loading of the musculoskeletal system, resulting in or exacerbating back, neck, shoulder and other body pain.

To combat postural fixity and other problems associated with sitting at a desk for extended periods of time, exercise apparatuses have been developed for use in the workplace. However, conventional devices may be ill-suited for both performing desk-related tasks, such as computing, reading, writing, and similar activities, and exercising, primarily because the dimensions of conventional devices may preclude effective use when positioned beneath a desk or similar fixture. Complications may arise with the use of conventional devices including but not limited to collisions between the user and the underneath surface of the desk and undesirable movement of the device in relation to the support surface. Thus, there remains a need for an exercise apparatus that can be effectively used by a user in seated relation to a desk or similar fixture.

III. SUMMARY OF THE INVENTION

Accordingly, a broad object of the invention can be to provide a motion resistance apparatus having a configuration which located beneath a fixed height surface allows normal operation of the motion resistance apparatus by a user in discrete seated relation to the fixed height surface and avoids contact of the user with the fixed height surface.

Another broad object of the invention can be to provide using a motion resistance apparatus configured to remain in substantially fixed relation or minimize movement of the apparatus over a support surface during normal use.

Another broad object of the invention can be to provide a method of using a motion resistance apparatus located beneath a fixed height surface by a user in discrete seated relation to the fixed height surface which avoids contact of the user with the fixed height surface.

Naturally, further objects of the invention are disclosed throughout other areas of the specification, drawings, and claims.

IV. BRIEF DESCRIPTION OF THE DRAWINGS

V. DETAILED DESCRIPTION OF THE INVENTION

Generally motion resistance apparatuses and methods of making and using such motion resistance apparatuses which include a crank assembly including an axial element capable of rotation about a rotation axis within a resistance assembly coupled to a frame configured to engage a support surface and locate the rotation axis of the axial element at a distance from the support surface.

Figure 1:
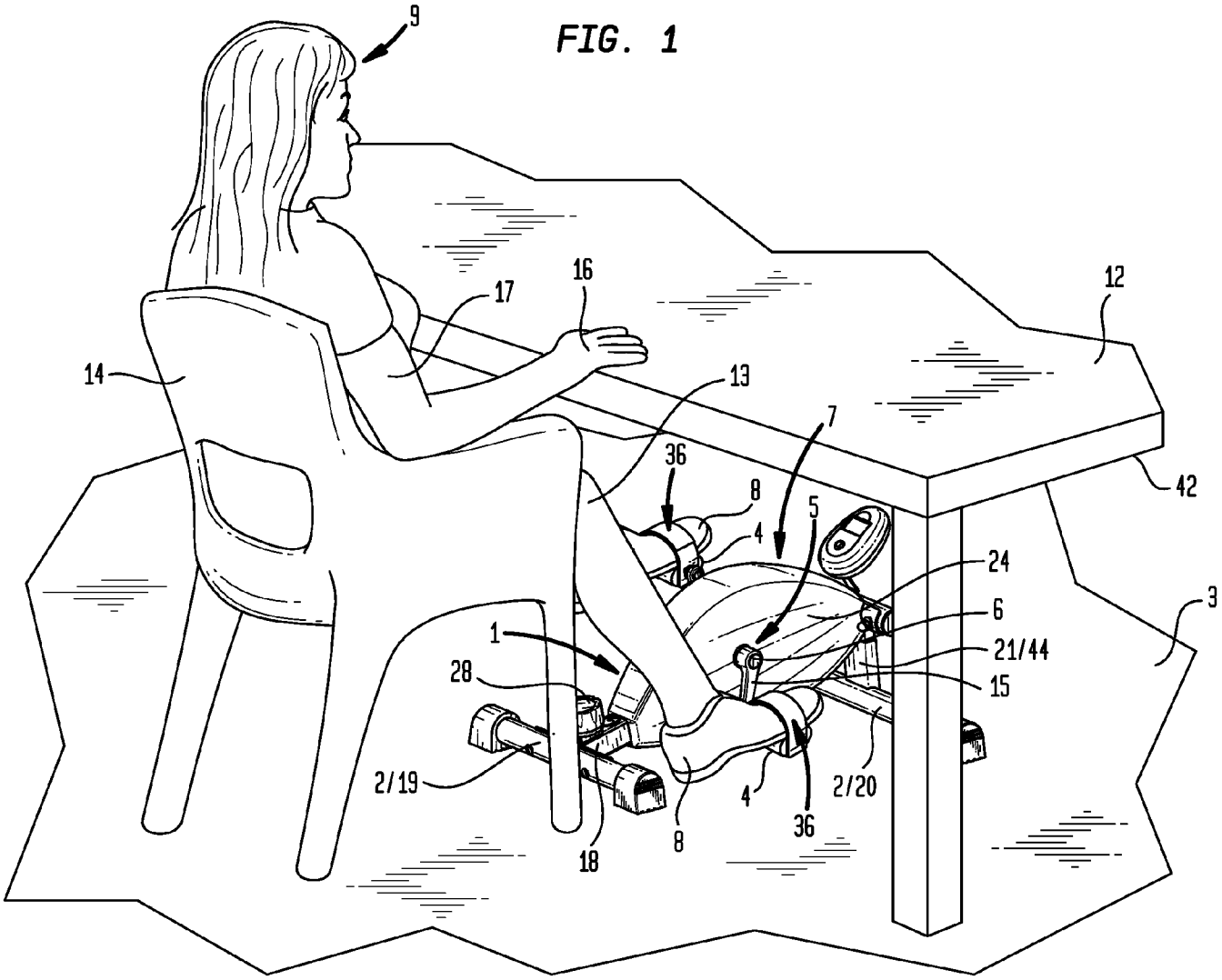
FIG. 1 is an illustration of a method of using a particular embodiment of the inventive motion resistance apparatus.

Now referring primarily to FIG. 1, a particular method of using the inventive motion resistance apparatus (1) is shown in which a frame (2) can be positioned on a support surface (3) to position a pair of pedal elements (4) of the crank assembly (5) having an axial element (6) rotatably coupled with a resistance assembly (7) for corresponding engagement by a pair of feet (8) of a user (9). The resistance assembly (7) can apply a resisting force to rotation of the crank assembly (5). Correspondingly, the user (9) can apply a countering force to at least one of the pair of pedal elements (4) to overcome the resisting force and rotate the crank assembly (5) coupled to the resistance assembly (7).

Figure 2:
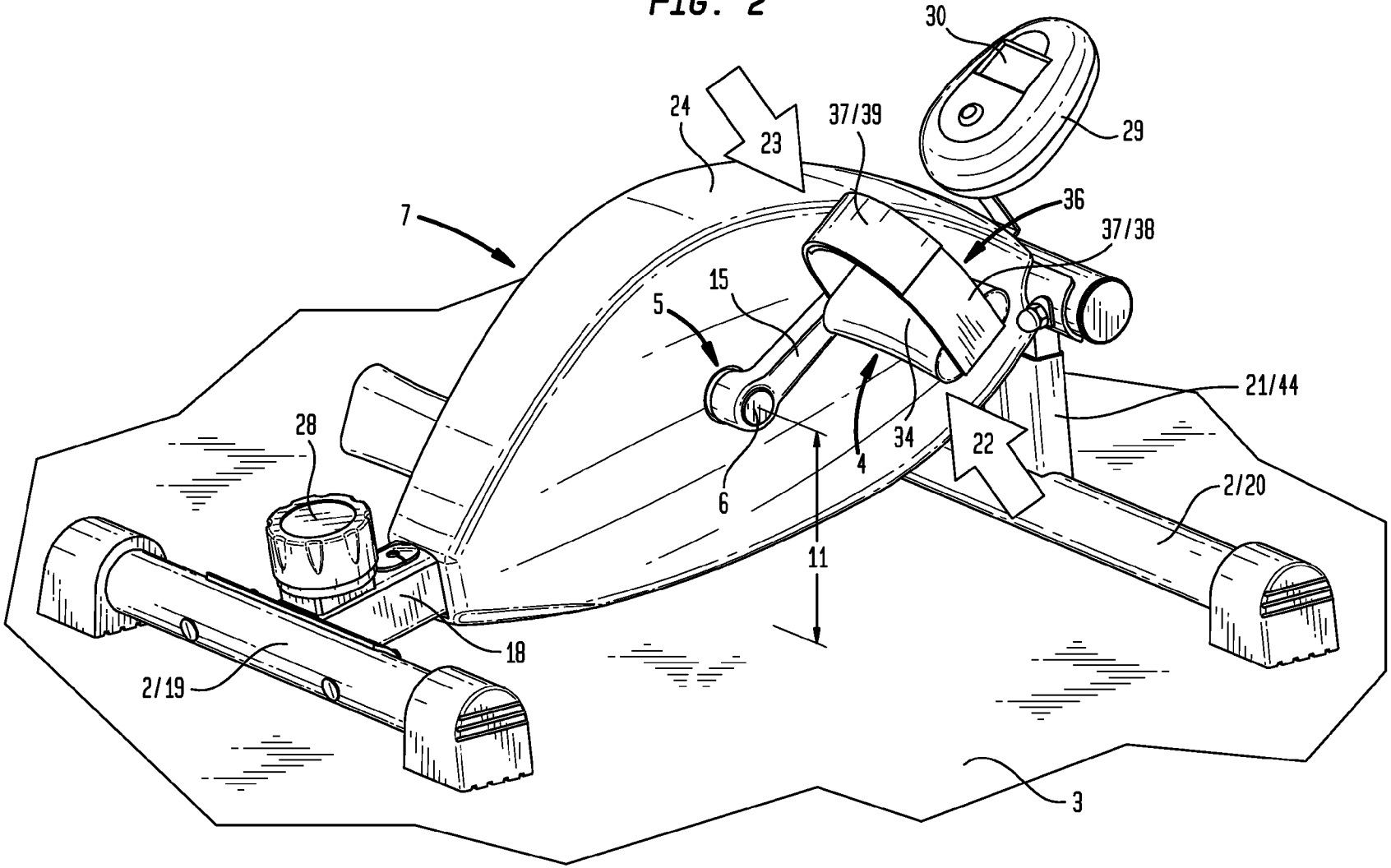
FIG. 2 is a perspective view of a particular embodiment of the inventive motion resistance apparatus.
Figure 5:
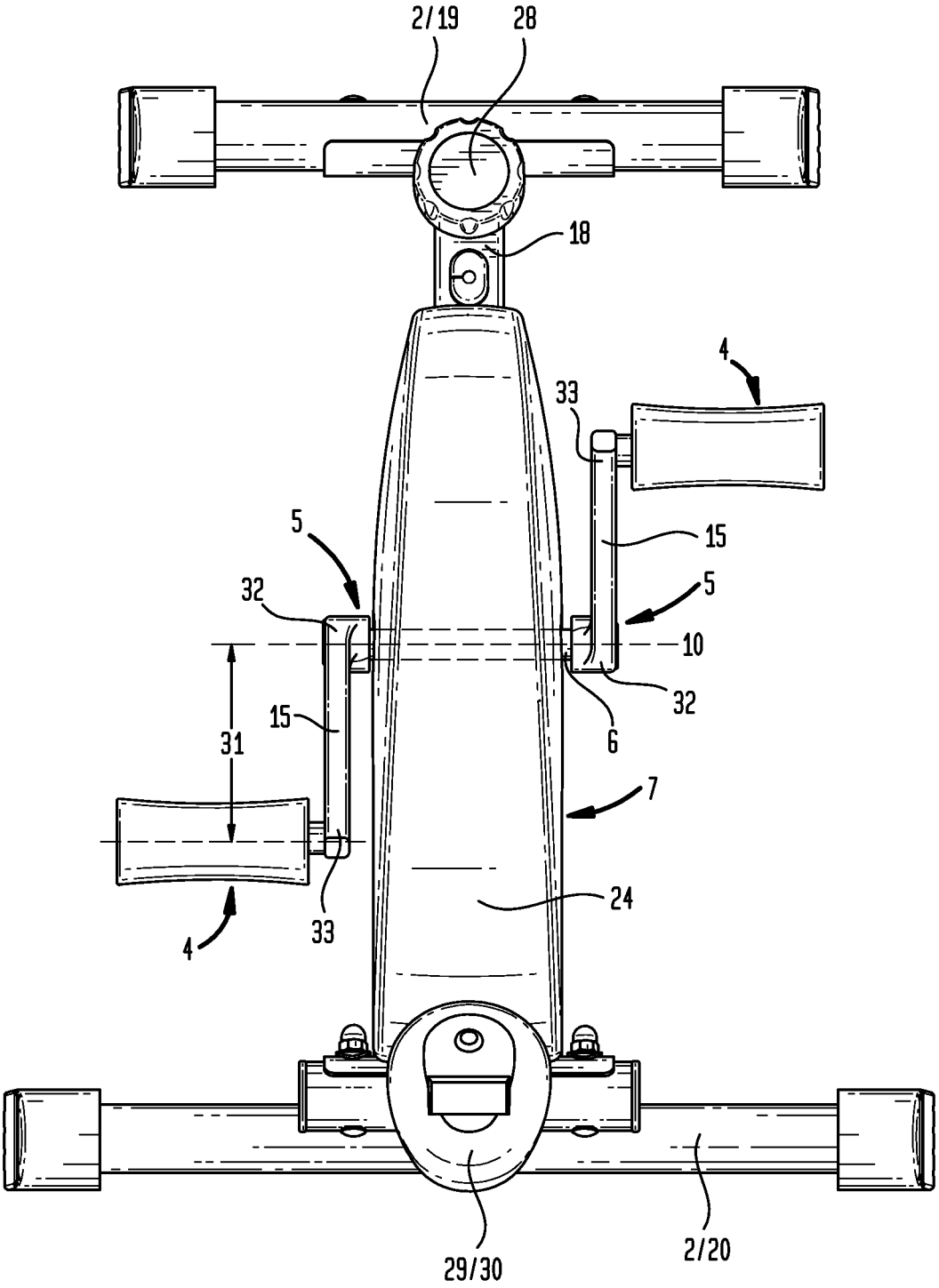
FIG. 5 is a top plan view of a particular embodiment of the inventive motion resistance apparatus.

As to particular embodiments of the method, the pair of feet (8) of the user (9) can correspondingly engage the pair of pedal elements (4) of the crank assembly (5) while in a seated position. As to particular embodiments of the method, the frame (2) can be configured to locate the rotation axis (10) of the axial element (6) of the crank assembly (5) at a vertical distance (11) (as shown in the example of FIGS. 2 and 5) sufficiently close to the support surface (3) (for example between four inches and twelve inches) allowing the user (9) to rotate the crank assembly (5) of the motion resistance apparatus (1) having a location beneath a desk (12), or similar fixture, avoiding or without contacting of the lower body portion (13) of the user (9) (for example, a leg or knee of the user (9), with the desk (12) or similar fixture). The user (9) can be supported by a chair (14) or similar fixture discrete from the desk (12), with the motion resistance apparatus (1) located beneath a desk (12) while rotating the crank assembly (5) with the user's (9) pair of feet (8) correspondingly engaged to the pair of pedal elements (4) each of which by rotation circumscribe a circular path having a diameter of between about four and twelve inches depending upon the length of the crank arms (15); however, the example of FIG. 1 is not intended to limit the numerous and varied environments that can provide a support surface (3) for use of the motion resistance apparatus (1).

As to particular embodiments of the method, the user (9) can correspondingly engage the pair of pedal elements (4) with one of a pair of hands (16), thereby supplying a countering force to the resistance assembly (7) and, correspondingly, exercising the user's upper body portion (17).

Accordingly, a variety of activities can be performed by the user (9) while engaging the motion resistance apparatus (1) including as non-limiting examples: working at a desk, watching a television, reading a book, playing a video game, talking on a phone, or the like.

Now referring primarily to FIG. 2, embodiments of the inventive motion resistance apparatus can include a frame (2), having an elongate member (18) disposed between a first support surface engagement member (19) and a second support surface engagement member (20). As to particular embodiments, the frame (2) can further include a support member (21) disposed upright between the second support surface engagement member (20) and the elongate member (18). The support member (21) can be of greater or lesser length to correspondingly increase or decrease the distance of the elongate member (18) in relation to the second support surface engagement member (20). The frame (2) can be coupled to a resistance assembly (7) having a crank assembly (5) including an axial element (6) capable of rotation about a rotation axis (10) (see exemplary rotation axis in FIG. 5) within the resistance assembly (7). The resistance assembly (7) can operate to apply a resisting force (22) to the axial element (6) in response to a user-supplied countering force (23).

The frame (2) can be produced from any materials allowing normal operation of the motion resistance apparatus, including, as non-limiting examples: plastics, metals, composites, or the like and combinations thereof. The resistance assembly (7) can apply resistive forces by one or more of direct tension, direct friction, wind resistance, magnetic resistance, or the other resistive assemblies or elements.

Figure 3:
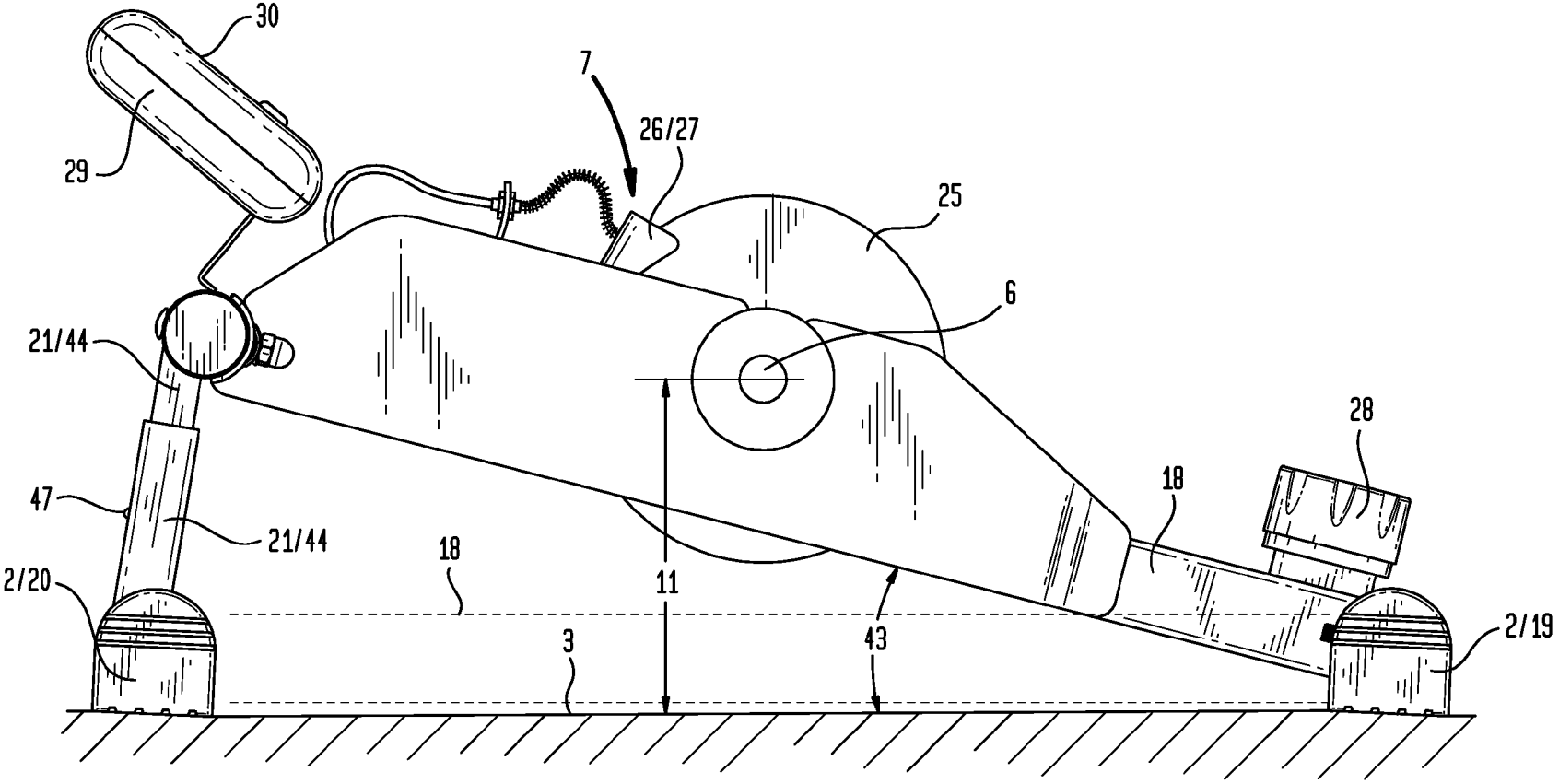
FIG. 3 is a first side elevation view of a particular embodiment of the inventive motion resistance apparatus without the housing element.

Now referring primarily to FIG. 3, a particular a resistance assembly (7) which can be coupled to the frame (2) is shown without the enclosing housing element (24) (see exemplary housing element in FIG. 2). The exemplary resistance assembly (7) includes a flywheel (25) rotatably coupled in relation to the elongate member (18) of the frame (2). The flywheel (25) can be formed from one or more materials, including but not limited to, non-ferrous materials, such as aluminum or copper, and relatively dense materials, such as steel.

A brake assembly (26) can be operatively associated with the flywheel (25) to resist or otherwise oppose rotation of the flywheel (25). As to particular embodiments, the brake assembly (26) can include a magnet element (27), having one or more magnets, positioned proximate the flywheel (25) to generate a magnetic field that resists rotation of the flywheel (25). The one or more magnets can be formed of any suitable magnetic material and as to particular embodiments from rare earth elements such as neodymium.

The resistance assembly (7) can apply a variably adjustable resisting force (22) (see exemplary resisting force in FIG. 2) in response to a user-supplied countering force (23) (see exemplary countering force (22) in FIG. 2). According to one embodiment of the inventive motion resistance apparatus (1), flywheel (25) rotation resistance can be varied by changing the position of the magnet element (27) relative to the flywheel (25). As the magnet element (27) overlaps a greater portion of the flywheel (25), resistance to the rotation of the flywheel (25) through the magnetic field can increase. An increase in flywheel (25) rotation resistance can require a user (9) to exert more countering force (23) (see exemplary countering force in FIG. 2) on the crank assembly (5) to rotate the flywheel (25), and correspondingly, a decrease in resistance to the rotation of the flywheel (25) can require the user (9) to exert less countering force (23) (see exemplary countering force in FIG. 2) on the crank assembly (5) to rotate the flywheel (25). A user (9) can variably adjust the position of the magnet element (27) and, correspondingly, the resisting force (22) (see exemplary resisting force in FIG. 2) of the resistance assembly (7) by corresponding adjustment of a resistance control element (28), such as rotation of a knob, operatively associated with the magnet element (27). In accordance with one embodiment of the present invention, a flywheel (25) rotation resistance range can be about ten Watts to about one hundred and thirty Watts when the flywheel (25) rotates at a frequency of about sixty revolutions per minute. At a flywheel (25) rotation rate of one hundred and twenty revolutions per minute, the flywheel (25) rotation resistance range can be about twenty-five Watts to about four hundred Watts.

As to particular embodiments, the resistance assembly (7) can be coupled to a monitoring system (29). The monitoring system (29) can be configured to determine parameters relative to movement of the user (9) engaged with the resistance assembly (7), including but not limited to time, distance, speed and calories expended. Regarding the determination of calories expended during engagement of the user (9) with the resistance assembly (7), one embodiment of the inventive motion resistance apparatus (1) can include a calorie calculator having one or more physical characteristics of the user (9), for example but not limited to a gender, a height, a weight or an age, incorporated into the calorie expenditure calculations. Output of the monitoring system (29) can be displayed on the display system (30). The monitoring system (29) and the display system (30) can be configured to transmit and receive signals representing information between the monitoring system (29), the display system (30), one or more attached devices and/or one or more remote devices suitable for signal transmission and reception via a wireless or wired connection.

Figure 4:
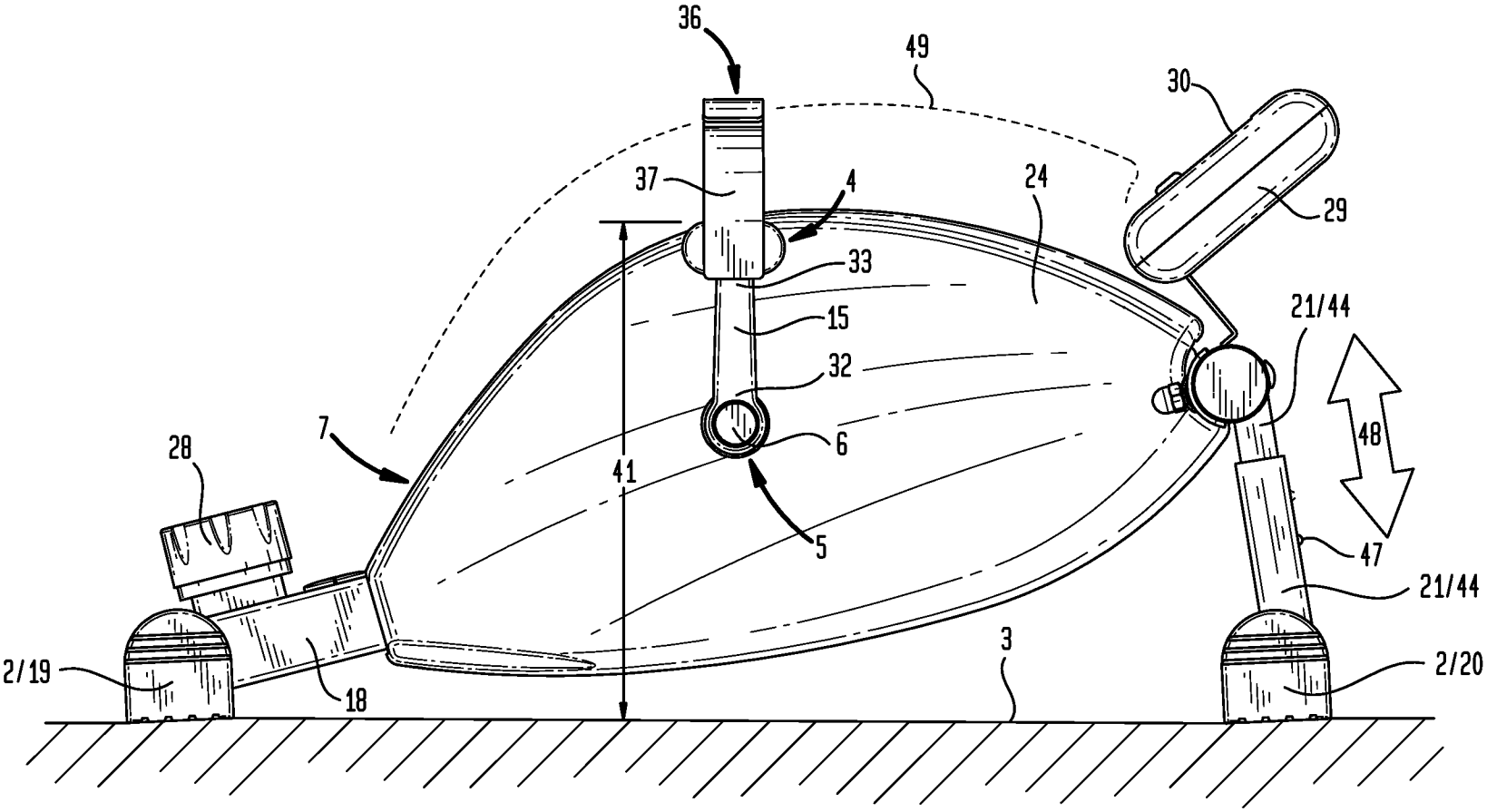
FIG. 4 is a second side elevation view of a particular embodiment of the inventive motion resistance apparatus.

Now referring primarily to FIGS. 3 through 5, the resistance assembly (7) can include a crank assembly (5) having an axial element (6) capable of rotation about a rotation axis (10) within the resistance assembly (7). In accordance with particular embodiments of the present invention, the axial element (6) can be operatively coupled to a flywheel (25) such that rotation of the axial element (6) causes rotation of the flywheel (25). Embodiments can further include crank arms (15), each having a crank arm length (31) disposed between a crank arm first end (32) and a crank arm second end (33). A crank arm first end (32) can be coupled proximate each of the opposed ends of the axial element (6).

Now referring primarily to FIGS. 1 through 8, a pedal element (4) configured to receive a user-supplied countering force (23) can be coupled or rotatably coupled to the crank arm second end (33).

Now referring primarily to FIGS. 1 through 8, a pedal element (4) can include an engagement surface (34) opposite a nonengagement surface (35). A user (9) can engage the crank assembly (5) by supplying a countering force (23) to the engagement surface (34) of each one of the pair of pedal elements (4), located on opposing sides of the resistance assembly (7), thereby causing rotation of the pedal elements (4) about the rotation axis (10). A pedal element (4) can be, but is not necessarily, rotated in both a clockwise direction and a counterclockwise direction about the rotation axis (10).

As to other particular embodiments, a countering force (23) supplied to the pedal element (4) can be transferred to an axial element (6) via a crank arm (15), causing rotation of the axial element (6) about the rotation axis (10), thus engaging the resistance assembly (7). Corresponding with the rotational direction of the countering force (23) supplied by a user (9) to the pedal element (4), the axial element (6) can be, but is not necessarily, rotated in both a clockwise direction and a counterclockwise direction about the rotation axis (10).

Figure 6:
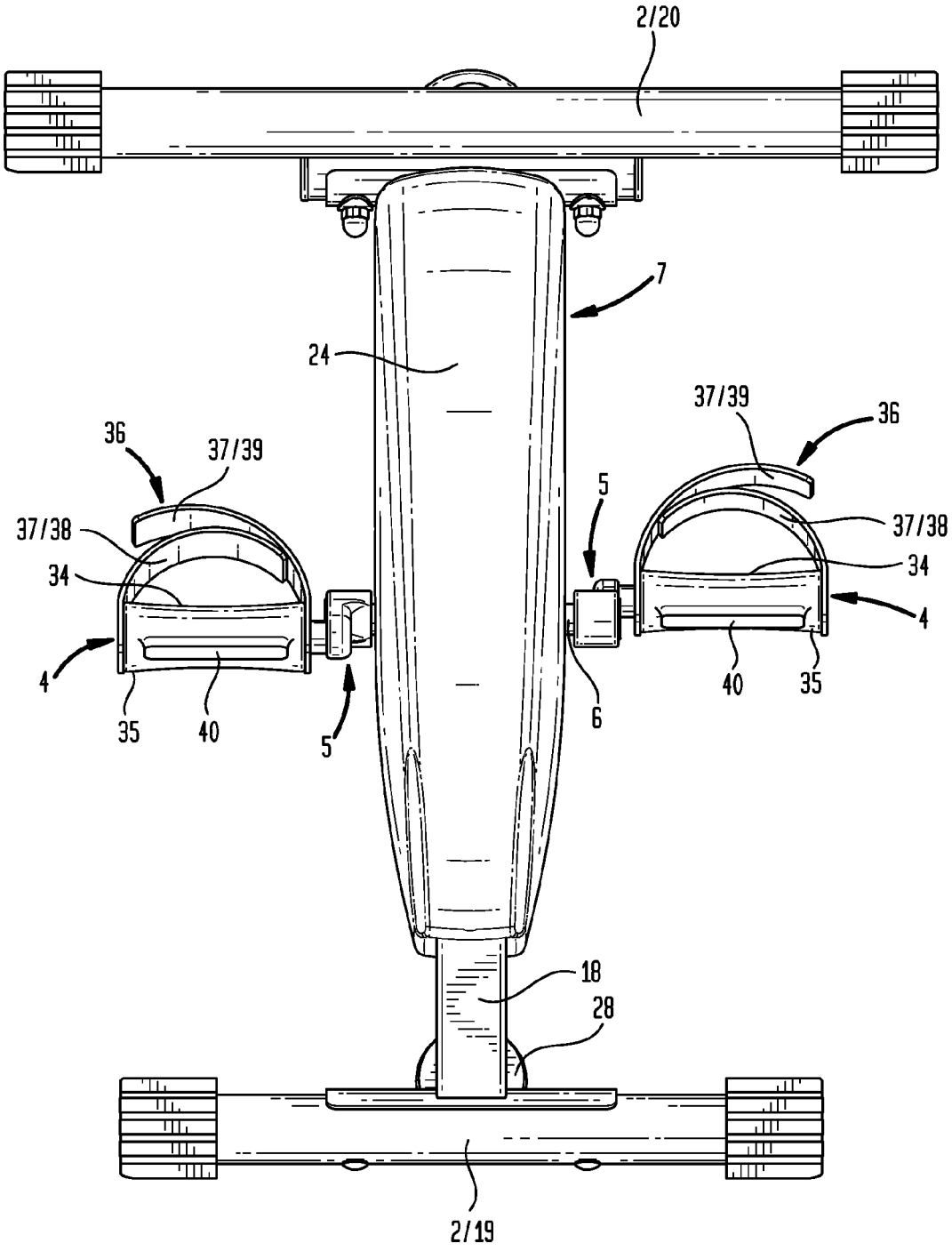
FIG. 6 is a bottom plan view of a particular embodiment of the inventive motion resistance apparatus.
Figure 7:
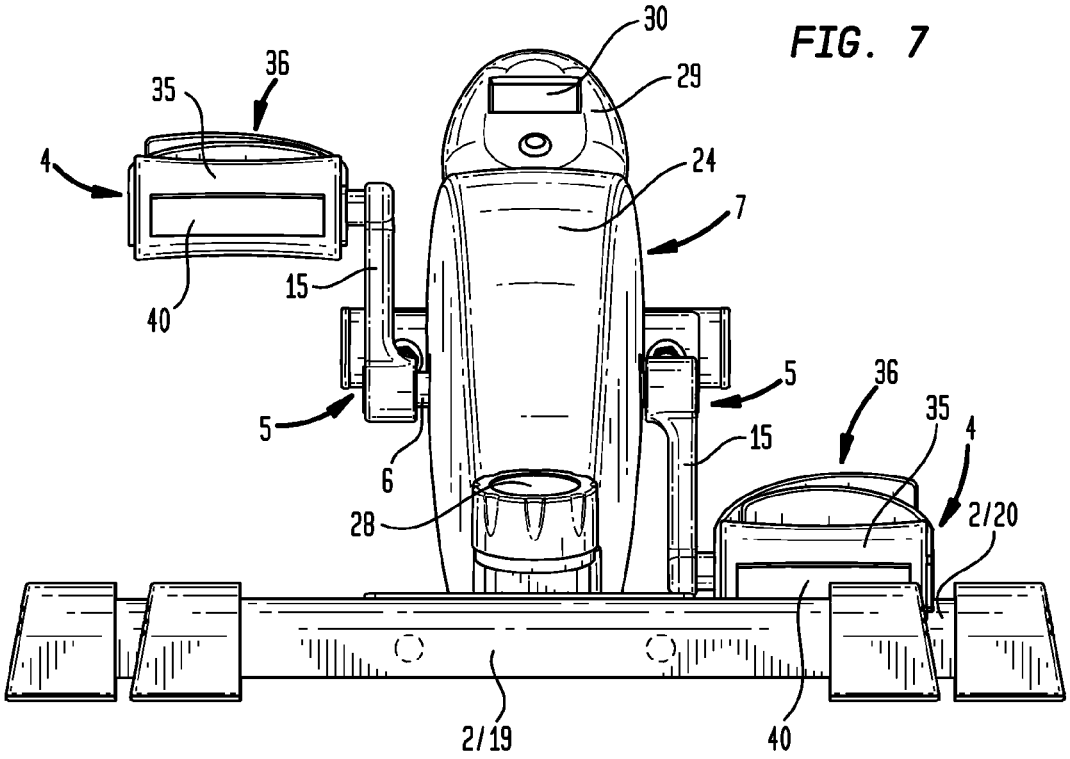
FIG. 7 is a first end elevation view of a particular embodiment of the inventive motion resistance apparatus.
Figure 8:
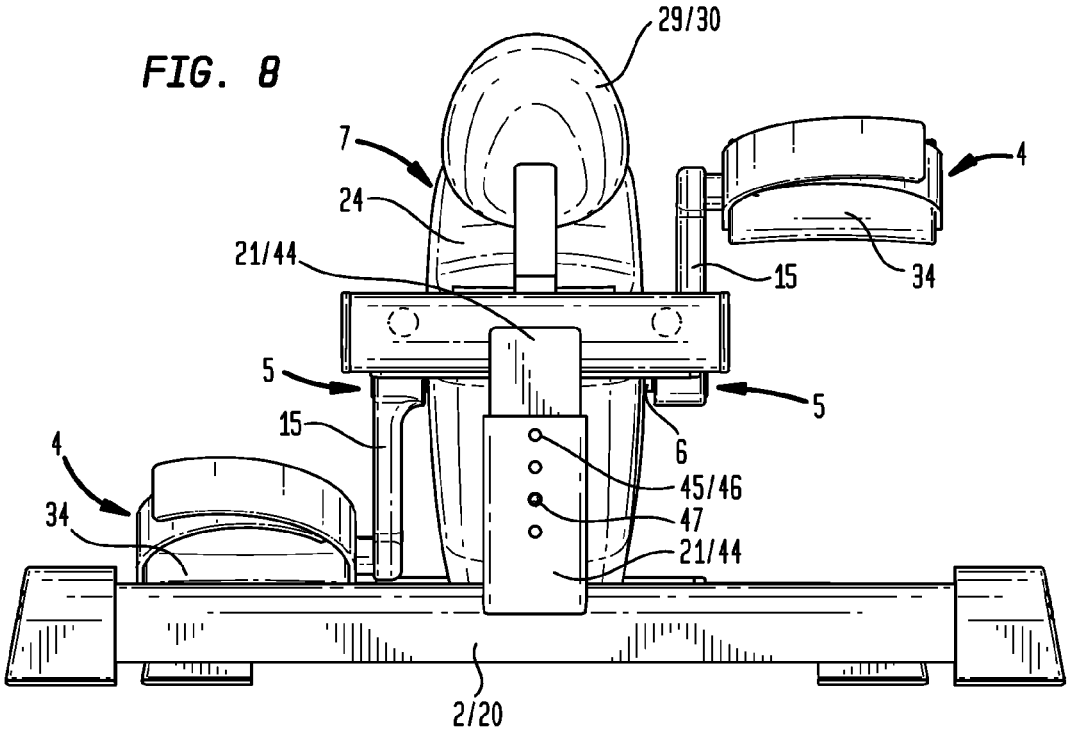
FIG. 8 is a second end elevation view of a particular embodiment of the inventive motion resistance apparatus.

As to particular embodiments the pedal element (4) can further include a securement element (36) coupled to the pedal element (4). As to particular embodiments, the securement element (36) can include a pair of straps (37) each having a strap first end (38) coupled to the pedal element (4) and a strap second end (39) configured for overlapping releasable fixed engagement. As to other embodiments, the pedal element (4) can include a weight element (40) (as shown in the examples of FIGS. 6 and 7) coupled to the nonengagement surface (35) of the pedal element (4) and configured to orient the engagement surface (34) in a relatively upward facing direction and the nonengagement surface (35) in a relatively downward facing direction in relation to a support surface (3).

Again referring primarily to FIGS. 1 through 8, the resistance assembly (7) can be coupled to a frame (2) configured to engage a support surface (3), such as a floor or the like, to position the rotation axis (10) at a vertical distance (11) of less than about twelve inches (less than about 30.5 centimeters "cm") from the support surface (3). The rotation axis vertical distance (11) can vary depending upon the embodiment of the invention and can include a range from about four inches (about 10 cm) to about twelve inches (about 30.5 cm). As to particular embodiments, the rotation axis vertical distance (11) can be selected from the group including or consisting of: between about four inches and about six inches, between about five inches and about seven inches, between about six inches and about eight inches, between about seven inches and about nine inches, between about eight inches and about ten inches, between about nine inches and about eleven inches, and between about ten inches and about twelve inches. As to particular embodiments, the frame (2) can be configured to locate the rotation axis (10) at a vertical distance (11) of about six inches above the support surface (3).

Depending upon the rotation axis vertical distance (11), the crank arm (15) can have a corresponding greater or lesser crank arm length (31). Accordingly, crank arm lengths (31) can include a range from about two inches to about twelve inches. As to particular embodiments, the crank arm length (31) can be selected from the group including or consisting of: between about two inches and about four inches, between about three inches and about five inches, between about four inches and about six inches, between about five inches and about seven inches, between about six inches and about eight inches, between about seven inches and about nine inches, between about eight inches and about ten inches, between about nine inches and about eleven inches, and between about ten inches and about twelve inches.

As to particular embodiments, the crank arm (15) can have a crank arm length (31) of about three and one-half inches, compelling a pedal element (4) to rotate about the rotation axis (10) within a circular path having a diameter of about seven inches. Accordingly, if the embodiment has the rotation axis vertical distance (11) located at about six inches, then the maximum pedal vertical height (41) of the pedal element (4) during circumferential travel about the rotation axis (10) can be about ten inches from the support surface (3), allowing a user (9) to engage the inventive motion resistance apparatus (1) while seated at a desk (12) having a vertical height of about twenty-seven inches between the support surface (3) and the desk (12), without contacting a portion of the lower body (13) of the user (9) with the underneath surface (42) of the desk (12) (as shown in the example of FIG. 1). The maximum pedal vertical height (41) can include a range from about five inches to about fifteen inches. As to particular embodiments, the maximum pedal vertical height (41) can be selected from the group including or consisting of: between about five inches and about seven inches, between about six inches and about eight inches, between about seven inches and about nine inches, between about eight inches and about ten inches, between about nine inches and about eleven inches, between about ten inches and about twelve inches, between about eleven inches and about thirteen inches, between about twelve inches and about fourteen inches, and between about thirteen inches and about fifteen inches.

Again referring primarily to FIGS. 1 through 8, the resistance assembly (7) can be coupled to the elongate member (18) of the frame (2) at a location between the first support surface engagement member (19) and a second support surface engagement member (20). The elongate member (18) can be configured to locate the resistance assembly (7) at a position which locates the rotation axis (10) of the resistance assembly (7) at a predetermined rotation axis vertical distance (11) from the support surface (3).

Now referring primarily to FIG. 3, the configuration of the frame (2) can position the elongate member (18) disposed between the two support surface engagement members (19)(20) in a substantially parallel relation to the support surface (3) (as shown in broken line by the example of FIG. 3).

Again referring to FIG. 3, the elongate member (18) can be disposed in angled relation to the support surface (3). Depending upon the embodiment, the angle of inclination (43) can be between zero degrees and about thirty degrees. Accordingly, with an increase in the angle of inclination (43), there is a corresponding increase in the rotation axis vertical distance (11) in relation to the support surface (3). The angle of inclination (43) can be selected from the group including or consisting of: between zero and about ten degrees, between about five degrees and about fifteen degrees, between about ten degrees and about twenty degrees, between about fifteen degrees and about twenty five degrees, and between about twenty degrees and about thirty degrees.

As to particular embodiments, the frame (2) can include a support member (21) disposed upright between the second support surface engagement member (20) and the elongate member (18). The support member (21) length can be selected to dispose the elongate member (18) at a predetermined angle of inclination (43) in relation to the support surface (3), as above described.

Typically, the elongate member (18) will have greater vertical height distal from the user (9) when the user (9)

engages the inventive motion resistance apparatus (1). In this way, the elongate member (18) is angled relative to the support surface (3) in a relatively upward direction from the first support surface engagement member (19).

Again referring primarily to FIGS. 1 through 3, when engaging the inventive motion resistance apparatus (1), a user (9) can supply a countering force (23) to a resistance assembly (7) in a direction relatively toward the second support surface engagement member (20) distal to the user (9). If at least a portion of the countering force (23) is not redirected, the inventive motion resistance apparatus (1) can disengage from the support surface (3) and undesirably move away from the user (9) corresponding to the direction of the user-supplied countering force (23). However, when the elongate member (18) has an angle of inclination (43) in relation to the support surface (3) which increases in vertical height approaching the second support surface engagement member (20), the second support surface engagement member (20) can be operational as a pivot, thereby directing a portion of the relatively forward-directed user-supplied countering force (23) in a relatively downward direction. The portion of the user-supplied countering force (23) that is directed in a relatively downward direction can function as an anchoring force, encouraging engagement of the frame (2) with the support surface (3), which can result in the inventive motion resistance apparatus (1) remaining in a preferable stationary position while engaged by the user (9).

Again referring primarily to FIGS. 1 through 3, as the angle of inclination (43) of the elongate member (18) in relation to a support surface (3) increases in a relatively upward direction from a first support surface engagement member (19), the portion of a user-supplied countering force (23) directed in a relatively downward direction increases, thereby increasing the anchoring force and decreasing undesirable movement of the inventive motion resistance apparatus (1). By way of contrast, as the angle of inclination (43) of the elongate member (18) relative to the support surface (3) increases, the rotation axis distance (11) from the support surface (3) can also correspondingly increase, thereby positioning a lower body portion (13) of a user (9) closer to the underneath surface (42) of the user's desk (12) when the user (9) engages the motion resistance apparatus (1), increasing likelihood of engagement of the lower body portion (13) of the user (9) and the underneath surface (42) of the desk (12).

As to particular embodiments, an unexpectedly good configuration of the elongate member (18) which minimizes potential for, firstly, engagement of the lower body portion (13) of the user (9) and the underneath surface (42) of the desk (12) during operation of the motion resistance apparatus (1) and, secondly, undesirable movement of the inventive motion resistance apparatus (1) in relation to the support surface (3) comprises an angle of inclination (43) of the elongate member (18) relative to a support surface (3) of about fourteen to about eighteen degrees with increasing vertical height approaching the second support surface engagement member (20) with the rotation axis vertical distance (11) from the support surface (3) located at about six inches. In one embodiment of the present invention, an angle of inclination (43) of about sixteen degrees of the elongate member (18) in relation to the support surface (3) can be produced by coupling the support member (21) to the second support surface element (20) in a configuration which vertically elevates the corresponding end of the elongate member (18) at about six inches above the support surface (3).

As to particular embodiments, the support member (21) length can be fixed while as to other particular embodiments, the support member (21) length can be variably adjustable, thus allowing a user (9) of the inventive motion resistance apparatus (1) to adjust the angle of inclination (43) of the elongate member (18) relative to a support surface (3). As one example, the support member (21) can be provided in the form of a pair of tubular support members (44) telescopingly engaged with a plurality of aperture elements (45) along the length of the first and second of the pair of tubular support members (44) slidably alignable to provide a pass through (46) which insertingly receives a pin element (47) to fix the desired length of the support member (21). In this way, the length of the support member (21) can be slidably increased or decreased (48). Correspondingly, the vertical height of the resistance assembly (7) can be increased (49) (as shown in broken line by the example of FIG. 4) or decreased.

As can be easily understood from the foregoing, the basic concepts of the present invention may be embodied in a variety of ways. The invention involves numerous and varied embodiments of a motion resistance apparatus and methods for making and using such motion resistance apparatus including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "pedal" should be understood to encompass disclosure of the act of "pedaling"—whether explicitly discussed or not—and, conversely, were there effectively disclosure of the act of "pedaling", such a disclosure should be understood to encompass disclosure of a "pedal" and even a "means for pedaling." Such alternative terms for each element or step are to be understood to be explicitly included in the description.

In addition, as to each term used it should be understood that unless its utilization in this application is inconsistent with such interpretation, common dictionary definitions should be understood to include in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

All directional references herein (for example, upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims.

All connection references herein (for example, attached, coupled, connected, joined, and the like) are to be construed broadly and may include intermediate members between a connection of elements and relative movement between elements. As such, connection references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like.

Moreover, for the purposes of the present invention, the term "a" or "an" entity refers to one or more of that entity unless otherwise limited. As such, the terms "a" or "an", "one or more" and "at least one" can be used interchangeably herein. Furthermore, the team "selected from the group consisting of" refers to one or more of the related elements in the list that follows, including combinations of two or more of the listed elements.

Thus, the applicant(s) should be understood to claim at least: i) each of the motion resistance apparatuses herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the particular embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A motion resistance apparatus, comprising:

a frame including a linear elongate member having opposing elongate member first and second ends;

an elongate support surface engagement member coupled to said elongate member second end in angled relation to said elongate member;

a support member medially coupled between said elongate member second end and said elongate support surface engagement member;

a resistance assembly medially coupled to said elongate member, said resistance assembly having a crank assembly including an axial element capable of rotation about a rotation axis; and a pair of pedal elements coupled to said axial element, each said pedal element circumscribing a circular path upon rotation about said rotation axis;

wherein said frame engaged to a support surface locates:

said rotation axis of said axial element at a distance from said support surface of not greater than twelve inches; and said elongate member first end at a first height and said elongate member second end at a second height which is greater than said first height; and wherein said elongate member has an angle of inclination in relation to said support surface of not greater than thirty degrees.

2. The motion resistance apparatus of claim 1, wherein said distance from said support surface is not less than four inches and not greater than twelve inches.

3. The motion resistance apparatus of claim 1, wherein said resistance assembly comprises one or more magnet elements.

4. The motion resistance apparatus of claim 1, wherein said resistance assembly provides variably adjustable resistance to rotation of said axial element.

5. The motion resistance apparatus of claim 1, wherein said axial element is rotatable in a clockwise and a counterclockwise direction about said rotation axis.

6. The motion resistance apparatus of claim 1, wherein said second height is not less than two inches and not greater than twelve inches.

7. The motion resistance apparatus of claim 6, wherein said second height has a fixed relation to said first height.

8. The motion resistance apparatus of claim 6, wherein said support member further comprises a variable height adjustment element operable to increase or decrease a support member length to correspondingly variably adjust said second height in relation to said first height.

9. The motion resistance apparatus of claim 6, wherein said support member comprises a pair of tubular support members telescopingly engaged to allow increase or decrease of said support member length and said variable height adjustment element has a configuration which releasably fixes said support member length.

10. The motion resistance apparatus of claim 1, wherein said crank assembly includes one or more crank arms having a crank arm first end opposite a crank arm second end, said crank arm first end coupled to said axial element and said crank arm second end coupled to said pedal element.

11. The motion resistance apparatus of claim 10, wherein said pedal element has an engagement surface opposite a nonengagement surface, wherein rotary movement of said pedal element about said rotations axis of said axial element results in a vertical height of said engagement surface of not greater than fifteen inches from said support surface.

* * * * *